United States Patent [19]

Dubertret et al.

[11] Patent Number: 4,878,954

[45] Date of Patent: Nov. 7, 1989

[54] PROCESS FOR IMPROVING THE DUCTILITY OF A PRODUCT OF ALLOY INVOLVING MARTENSITIC TRANSFORMATION AND USE THEREOF

[75] Inventors: Alain Dubertret, Sevres; Bernard Prandi, Faverges, both of France

[73] Assignee: Compagnie Europeenne Du Zirconium Cezus, Courbevoie, France

[21] Appl. No.: 208,035

[22] Filed: Jun. 17, 1988

[30] Foreign Application Priority Data

Jun. 24, 1987 [FR] France ..... 87 09272

[51] Int. Cl.[4] ..... C22C 9/01; C22F 1/08; C22F 1/10

[52] U.S. Cl. ..... 148/11.5 F; 148/11.5 N; 148/402

[58] Field of Search ..... 148/11.5 F, 11.5 N, 148/402

[56] References Cited

U.S. PATENT DOCUMENTS

| | | | |
|---|---|---|---|
| 4,067,752 | 1/1978 | Brook et al. | 148/402 |
| 4,304,613 | 12/1981 | Wang et al. | 148/402 |
| 4,707,196 | 11/1987 | Honma et al. | 148/402 |
| 4,953,253 | 4/1976 | Clark | 148/402 |

FOREIGN PATENT DOCUMENTS

| | | | |
|---|---|---|---|
| 0095798 | 12/1983 | European Pat. Off. | 148/402 |
| 0161066 | 11/1985 | European Pat. Off. . | |
| 0161952 | 12/1985 | European Pat. Off. . | |
| 0176272 | 4/1986 | European Pat. Off. | 148/402 |
| 0063654 | 4/1982 | Japan | 148/402 |
| 1136617 | 6/1986 | Japan | 148/402 |

OTHER PUBLICATIONS

Izuno, Jap. Jour. Electrical Engg., 20, (Sep. 1983), p.89.
Enami et al., Scripta Met., 5, (1971), p. 663.
Sade et al., Z. Metallkde, 79, (1988), 487.

*Primary Examiner*—Upendra Roy
*Attorney, Agent, or Firm*—Dennison, Meserole, Pollack & Scheiner

[57] ABSTRACT

A process is disclosed for improving the ductility of shape-memory alloy products based on Ti-Ni involving martensitic transformation. The process comprises at least one thermal treatment cycle of alternating hot and cold treatment, wherein the first thermal treatment cycle comprises a cold treatment at a temperature both lower than −50° C. and lower than $M_s$−50° C., where $M_s$ is the temperature at which martensitic transformation of the product begins, and a hot treatment of the product at a temperature of 700° to 900° C. Each optional subsequent thermal treatment cycle comprises a cold treatment of the product at a temperature both lower than −50° C. and lower than $M_s$−30° C., and a hot treatment of the product at a temperature of 600° to 900° C.

14 Claims, No Drawings

PROCESS FOR IMPROVING THE DUCTILITY OF A PRODUCT OF ALLOY INVOLVING MARTENSITIC TRANSFORMATION AND USE THEREOF

The present invention concerns a process for improving the ductility of a product of metal alloy involving martensitic transformation by means of a succession of thermal treatments and the use of that process for facilitating the transformation of semi-manufactured products of shape-memory alloy.

Many alloys involving martensitic transformation suffer from poor cold deformability, which is a particularly troublesome consideration when they are to be supplied in the form of semi-manufactured products of small thickness or diameter, for example between 0.5 and 3 mm. Such insufficiency of ductility in relation to working operations such as rolling, drawing, extruding or hammering affects in particular the transformation into semi-manufactured products of certain shape-memory alloys. Thus alloys of the types Ti-Ni 50/50 atomic % and Cu-Al 14 atomic % - Ni 4 atomic % typically have levels of deformation between annealing operations of 10% or less, which makes the cold transformation thereof an extraordinarily long and expensive process.

The applicants sought to find a way of overcoming that disadvantage, that is to say substantially improving the ductility of such alloys in regard to cold transformation operations, no solution to that problem being known as far as they are aware.

STATEMENT OF THE INVENTION

The present invention concerns a process for improving the ductility of a product of alloy involving martensitic transformation comprising one or more successive cycles of thermal treatments of the product. According to the invention the thermal treatment cycle or cycles each comprise a cold thermal treatment and a hot thermal treatment complying with the following conditions:

(a) The first cycle comprises a treatment of the product at a temperature lower than both −50° C. and ($M_s$31 50° C.), $M_s$ being the temperature at which martensitic transformation of the product begins, and a treatment of the product at a temperature which is at least equal to 700° C. and which does not involve recrystallisation of the product, (b) The following optional cycle or cycles each comprise a treatment of the product at a temperature lower both than −50° C. and ($M_s$−30° C.), and a treatment of the product at a temperature which is at least equal to 600° C., (c) All the hot treatments except possibly the last if it constitutes the last thermal treatment are at a temperature which does not involve recrystallisation of the product for the period selected for each of said treatments, and (d) The hot and cold treatments of the successive cycles are alternate.

After each hot or cold thermal treatment, the treated product is usually returned to ambient temperature for practical reasons. Each hot treatment has an effect of homogenisation and release of internal stresses, such release being incomplete since there is no recrystallisation effect, the residual stresses then having a favourable effect in regard to the cold treatment which follows same. Each cold treatment involves a fine martensite crystallisation effect and the succession of treatments gives rise to homogenation with softening of the matrix and, in the martensitic phase, increasingly fine crystallisation tending towards isotropy.

The process of the invention makes it possible in one or more cycles depending on the alloy in question to arrive at an exceptional level of ductility which is revealed for example by multiplication by a factor of 3 in the elogation to fracture in the tensile test. When a plurality of cycles of thermal treatments of the product is carried out, the improvement in ductility of the product involving martensitic transformation treated is progressive, the improvement effect of each of the successive cycles progressively decreasing so that in practice the procedure may be limited to at most 5 cycles and typically 3 cycles, 80 to 95% of the possible improvement in ductility then being attained.

The surprising modifications and in particular the improvement in ductility caused in the product by the cycle or cycles of thermal treatments according to the invention may in part be understood on the basis of a hypothesis explaining same. In the initial state of the treated product, on the microscopic and sub-microscopic scale there would be a substantial dispersion in respect of the ranges of local austenite/martensite transition temperatures around mean transition temperatures such as "$M_s$". The position of the temperature of the cold treatment of the invention relative to "$M_s$" then makes it possible to obtain martensitic transformation in the whole or almost the whole of the micro-zones of the product while the level of that treatment temperature which is lower than −50° C., in combination with the residual stresses in the product, results in fine martensite crystallisation which promotes subsequent homogenisation effects. That effect of a cold treatment is more reliably produced in regard to all of the micro-zones of the product when its temperature is even lower with resepct to $M_s$ and in practice is then lower than ($M_s$−100° C.). It has been noted that, undoubtedly because of the constriction in respect of the ranges of local transition temperatures around $M_s$ due to the first treatment operations, it was possible without disadvantage slightly to raise the cold temperature treatments of the cycles optionally following the first cycle, with respect to the temperature "$M_s$", which is an interesting aspect from the point of view of industrial production. For the cycles following the first, it is thus possible to have a maximum temperature of ($M_s$−30° C.) instead of ($M_s$31 50° C.) in the general case of ($M_s$−80° C.) instead of ($M_s$−100° C.) in the case of preferred settings for the cold treatment, the cold temperature or temperatures moreover remaining below −50° C. In the case of the hot treatment or treatments, the level of the temperature is important in itself to produce a homogenisation effect and stress relief, that temperature then being markedly above the transition temperatures of the micro-zones of the products and the temperatures "$M_s$" of the martensitic-transformation alloys typically being between −200° C. and +250° C.

The minimum temperature of the hot treatment or treatments may be brought towards "$M_s$", like the temperature of the cold treatment or treatments in the following optional cycles, the hot treatment temperature then remaining at least equal to 600° C.

Moreover in order to retain the homogenised or partially homogenised state produced by the hot treatment or by each of the hot treatments, it is preferable to cool the product by quenching, typically quenching with water, after the hot treatment or treatments.

When the product to be treated is in the hot-worked state, it is preferable to begin the first cycle of treatments according to the invention, which may be the only cycle of treatments, with the cold treatment thereof.

In contrast when the product to be treated is in a cold-worked state, it is better to begin the first cycle of treatments with the hot treatment thereof so as to have internal stresses which are adjusted to a low level prior to the cold treatment.

It has been found that the thermal treatments of the invention may be short, which is a great advantage from the point of view of industrial production: typically from a few seconds to 5 minutes for the cold treatments, from 30 seconds to 20 minutes for the hot treatments, the treated products in most cases being of a diameter or thickness of between 0.2 and 20 mm. Usual cooling agents for the cold treatments are liquid nitrogen (−196° C.) and dry ice (−70° C.), the former permitting treatment under good conditions in accordance with the invention of all alloys of a temperature "$M_s$" which is at least equal to −145° C. The cold treatments may be carried out by quenching in the cooling agent or by passing the product through that agent, or spraying or sprinkling that agent onto the material.

The process of the invention is a particularly attractive proposition for cold transformation of the following types of shape-memory alloys;

A—the alloys Ti-Ni without other addition with 48–52 atomic % of each metal, and the alloys Ti-Ni doped for example with Fe,Zr,Cu,Al or Co, one at least of those elements replacing a part of the titanium or the nickel. Their limit temperatures "$M_s$" range from −200° to +120° C., the most widely encountered values thereof being between −150° and +100° C. The hot treatment temperatures are then between 700° and 900° C., the recrystallisation temperatures for the treatment durations used themselves usually being higher than 920° C. Those treatment temperatures are typically between 750° C. and 850° C., in which case the durations of the treatment operations or the temperature-hold times of the product or products are then typically from 1 to 5 minutes for thin products of a diameter or thickness which is at most equal to 2 mm, and from 5 to 15 minutes for thicker products of a diameter or thickness of between 2 and 15 mm. The cold treatments typically use liquid nitrogen or dry ice.

B—copper-base alloys (% by weight):

Cu-Zn-Al, typically with 26 to 29% of Zn and 3 to 8% of Al

Cu-Al-Ni, typically with 13 to 15% of Al and 2 to 6% of Ni

Cu-Zn-Mn.

The temperatures "$M_s$" are typically between −140° C. and +200° C. The procedure uses a cycle of thermal treatments according to the invention, or 2 to 5 successive cycles. The hot treatment of the first cycle is from 1 to 15 minutes at a temperature chosen between 700° and 900° C., that duration and temperature making it possible to avoid recrystallisation of the product. The hot treatments of the following cycles of a procedure involving a plurality of cycles in accordance with the invention may be at the same temperature level or at a lower temperature which is at least equal to 600° C., as set forth in the general statement of the invention. The cold treatments may be very short, especially when dealing with fine wires or thin products and when they are carried out in a moving mode (for example by local immersion or spraying on liquid nitrogen).

Laboratory tests on samples of Cu-Zn-Al plate of a thickness of 0.5 mm have shown in qualitative terms that the cycles of thermal treatments of the invention could give rise to a simplification in the training procedure described in patent application No. EP-A-O 161 952 and applied to objects which are cut out from such samples, without doubt because of the fine homogenisation effect resulting from the treatment operations according to the invention. That improvement in training response involves the various shape-memory alloys.

C—iron-based alloys, for example of the types Fe-Mn-Si, Fe-Cr-Mn and Fe-Cr-Si.

Besides a surprising improvement in the ductility of the products of martensitic-transformation alloy considerably facilitating cold or medium-temperature transformation thereof, the process of the invention thus gives the following advantages;

stabilisation of the austenitic and/or martensitic states, resulting from the modification with constriction of the local points and intervals of austenite/martensite transformation of the product;

improvement in the educational aptitude of the semi-manufactured products of shape-memory alloy, and no mechanical treatment is associated with the successive thermal treatments of the process according to the invention, which facilitates performance of that process.

TESTS

The following tests will illustrate the application of the process of the invention and the effects thereof.

First Series of Tests

These tests involved using bars $\phi$ of 18 mm in the crude hot-extruded condition, of Cu-Al-Ni, involving 3 compositions as follows (in atomic %):

(C1) Cu-Al 15%—Ni 4% with $M_s$=150° C.

(C2) Cu-Al 14%—Ni 4% with $M_s$ close to 0° C.

(C3) Cu-Al 13%—Ni 4% with $M_s$=+180° C.

Discs of a thickness of 3 mm, which were cut from the bars of the three compositions, were each co-rolled at 900° C. approximately between two discs of stainless steel of type AISI 304. Ductility is subsequently evaluated by a simple bending test.

The rolled discs, when separated from their coverings of stainless steel, were then immersed for 3 to 4 minutes in liquid nitrogen and then, after returning to ambient temperature, treated for 1 minute at a temperature between 800° and 900° C. and quenched with water, the combination of those cold and hot treatments forming the first cycle of the process according to the invention.

It was then found that there was an increase in ductility which was scarcely perceptible for composition C1 and very marked for compositions C2 and C3. The cycles of thermal treatments were continued on some of the samples of each composition, going up to a total of 15 cycles.

After the third cycle, compositions C2 and C3 enjoy very good ductility with, as it was possible to note at ambient temperature in respect of composition C3, a fine martensite with isotropic distribution. The ductility of composition C1 is poor.

After 15 cycles, C2 and C3 show shape memory in addition to very good ductility. As regards ductility, it was estimated that 90 to 95% of the improvement in ductility was acquired after 3 cycles.

Second Series of Tests

The starting material used for these tests was an ingot of Ti-Ni 50/50 atomic % produced by arc melting under vacuum. The ingot was transformed into forged bars which were then treated for 30 minutes at 700° C., from which testpieces of 0.5 mm were machined, the state (To) being the reference state, with an elongation to fracture in the tensile test of 16.9%.

Taking the testpieces in state (To), deformation was produced by elongation on a drawing bench followed by thermal treatments and a tensile test, using four different sequences starting from state (To):

(T1)
- deformation with elongation of 9.9%
- treatment 10 minutes in liquid nitrogen
- tensile test: E %=2.4.

(T2)
- deformation with elongation of 9.7%
- treatment 10 minutes at 500° C.+quenching with water
- tensile test: E %=11.6.

(T3)
- deformation with elongation of 9.8%
- treatment 10 minutes at 800° C.+quenching with water
- treatment 10 minutes in liquid nitrogen, return to ambient temperature
- tensile test: E %=49.

(T4)
- deformation with elongation of 10%, causing the bar to fracture
- by treatment at 800° C. not followed by a cold treatment according to the invention, the result would have been a slightly improved elongation in %, namely about 15 to 20%.

The sequence (T3) shows in that case the surprising effect on E % of a single cycle of thermal treatments according to the invention.

It is to be observed that the temperature at which recrystallisation begins for a hot treatment of 10 minutes, for the present alloy, is 910° to 920° C. and that a risk of burning occurs only above 950° C. The considerable increase in tensile elongation corresponds here to the possibility of deformation with elongation of 35% approximately, prior to the following softening or annealing thermal treatment, instead of less than 10% as previously.

The use of a cycle of thermal treatments according to the invention instead of the conventional intermediate annealing operation or operations makes it possible to continue transformation with substantial amounts of deformation between intermediate treatments.

What is claimed is:

1. A process for improving the ductility of a shape-memory alloy product based on Ti-Ni involving martensitic transformation, comprising at least one thermal treatment cycle of alternating cold and hot treatments, wherein the first said thermal treatment cycle comprises a cold treatment of the product at a temperature both lower than −50° C. and lower than ($M_s$−50° C.) where $M_s$ is the temperature at which martensitic transformation of the product begins, and a hot treatment of the product at a temperature of 700°-900° C., which does not result in recrystallization of the product.

2. A process according to claim 1, additionally comprising at least one thermal treatment cycle subsequent to said first thermal treatment cycle, each said subsequent cycle comprising a cold treatment of the product at a temperature both lower than −50° and lower than ($M_s$−30° C.) and a hot treatment of the product at a temperature of 600°-900° C.

3. A process according to claim 1 or 2 wherein the temperature of the cold treatment of the first cycle is lower both than −50° C. and ($M_s$−100° C.).

4. A process according to claim 1 or 2 wherein the product is cooled by quenching with water after each hot treatment.

5. A process according to claim 1 or 2 wherein liquid nitrogen or dry ice is used as cooling agent of each cold treatment.

6. A process according to claim 1 or 2 wherein, when the product to be treated is in the hot-worked state, the first cycle is begun with the cold treatment thereof.

7. A process according to claim 1 or 2, wherein, when the product to be treated is in a cold-worked state, the first cycle is begun with the hot treatment thereof.

8. A process according to claim 1 or 2 wherein the cycles of thermal treatments number from 1 to 5.

9. A process according to claim 1 or 2, additionally comprising a final thermal treatment cycle including a heat treatment which results in recrystallization of the product.

10. Process according to claim 1 or 2, wherein the alloy product is a semi-finished product.

11. A process according to claim 2, wherein the cold treatment temperature of each said subsequent cycle is lower than ($M_s$−80° C.).

12. Process according to claim 10, wherein the Ti-Ni alloy contains 48 to 52 atomic % Ni.

13. Process according to claim 10, wherein the product treated is of a thickness or diameter which does not exceed 2 mm, and each hot treatment takes place at a temperature between 750° and 850° C. for between 1 and 5 minutes.

14. Process according to claim 10, wherein the product treated is of a thickness or diameter between 2 and 5 mm, and each hot treatment takes place at a temperature between 750° and 850° C. for between 5 and 15 minutes.

* * * * *